United States Patent [19]

Jes

[11] Patent Number: 4,565,316

[45] Date of Patent: Jan. 21, 1986

[54] TWO-PIECE ASPARAGUS CARTON

[75] Inventor: Otto J. Jes, Long Beach, Calif.

[73] Assignee: Willamette Industries, Inc., Portland, Oreg.

[21] Appl. No.: 472,036

[22] Filed: Mar. 4, 1983

[51] Int. Cl.[4] ..... B65D 5/32

[52] U.S. Cl. ..... 229/23 BT; 229/16 D; 229/39 R; 229/43; 206/45.18

[58] Field of Search ..... 229/23 BT, 37 R, 40, 229/16 R, 16 D, 39 R, 44 CB, 45 R, 6 A, 43, 23 R, 23 A, 41 B; 206/45.3, 45.18, 45.19

[56] References Cited

U.S. PATENT DOCUMENTS

| | | | |
|---|---|---|---|
| 1,847,834 | 3/1932 | Iacobitti | 229/43 |
| 2,192,412 | 3/1940 | Reaume | 229/23 R |
| 2,351,165 | 6/1944 | Vergobbi | 229/37 R |
| 2,367,717 | 1/1945 | Davidson | 229/37 R |
| 2,572,610 | 10/1951 | Gilbert | 229/37 R |
| 3,286,900 | 11/1966 | Keith | 229/37 R |
| 3,332,602 | 7/1967 | Flax | 229/37 R |
| 3,863,829 | 2/1975 | Merrill | 229/16 D |
| 3,905,544 | 9/1975 | Tipton | 229/41 B |
| 4,002,288 | 1/1977 | Klupt | 229/39 R |
| 4,199,059 | 4/1980 | Maroszek | 206/45.18 |
| 4,396,144 | 8/1983 | Gutierrez | 229/23 BT |

FOREIGN PATENT DOCUMENTS

| | | | |
|---|---|---|---|
| 2008078 | 5/1979 | United Kingdom | 229/37 R |

*Primary Examiner*—Allan N. Shoap
*Assistant Examiner*—Bryon Gehman
*Attorney, Agent, or Firm*—Eugene D. Farley

[57] ABSTRACT

A carton for packing and shipping produce such as asparagus, the carton being formed in two pieces or sections. The first section of the carton is a lower box body having a bottom, two opposed upstanding side walls, a rear wall, and a front panel hinged to the bottom of the lower box body and foldable to a position wherein it slopes inwardly from vertical to vary the cross sectional area of the interior of the carton from top to bottom thereby supporting the asparagus stalks. The second section of the carton is an upper box cover having a top, two side walls, a front wall and a back wall, being dimensioned to telescope over the lower box body so that the outside of the assembled carton has a rectangular prismatic configuration.

12 Claims, 5 Drawing Figures

TWO-PIECE ASPARAGUS CARTON

BACKGROUND OF THE INVENTION

This invention relates to corrugated cartons, and more particularly to cartons for securely packing produce such as asparagus. The carton includes a slanted front panel to vary the cross sectional area of the interior of the carton from top to bottom, while maintaining a substantially rectangular exterior.

Asparagus is a fast-growing shoot or spear that is harvested while still in its active growth cycle. The vegetable is tapered in shape and has a tender tip which breaks easily. During transportation and storage, it is necessary to protect the tender tips from breakage.

It is common practice in the asparagus packing industry to subject the packed asparagus to a hydro-cooling bath to slow its growth rate. Thereafter it is necessary to keep the stalks cool and moist so that they will not be limp when they reach the market place. If kept moist, asparagus will continue to grow during transit.

Generally, asparagus has been packed in upstanding crates made of wood or plastic. These crates require a rigid construction and are expensive and bulky. They also present a storage problem at the packing site, and a disposal problem at the consumer site.

It is known to use cardboard cartons for packing asparagus. However, problems sometimes occur when stacking the prior art cartons upon each other for shipment. Some prior art cartons are made with a trapezoidal configuration in order to accomodate the tapered configuration of the asparagus stalks. Accordingly, when the boxes are stacked, the outside bottom edges of one box have a tendency to curl over the smaller top of the box below it.

The asparagus carton of my previous U.S. Pat. No. 4,353,495 has a rectangular outside configuration which solves this problem. However, as a one-piece carton, it is somewhat bulky to manufacture and to assemble.

Accordingly, it is the general object of the present invention to provide a carton for asparagus having a rectangular exterior contour and a sloping internal panel to support securely the length of the asparagus stalks.

Another object is to provide a carton which is easy to pack without damaging the asparagus stalks, and which protects the stalks during transportation and storage.

Another object is to provide a carton having a plurality of holes therein for rapid hydro-cooling and drainage of the asparagus.

A further object is to provide a wax-dipped carton to maintain carton rigidity in a wet environment.

Another object is to provide a carton having significant stacking strength.

A still further object is to provide a carton having resistance to torqueing about its vertical axis.

These and other objects and advantages of the present invention and the manner in which they are achieved will be made apparent in the following specification and claims.

SUMMARY OF THE INVENTION

In its basic concept, the presently described carton for packing and shipping asparagus is constructed in two sections, the first of which is a lower box body having a bottom, two opposed upstanding side walls, a rear wall, and a front panel hinged to the bottom and foldable to a position wherein it slopes inwardly from vertical to vary the cross sectional area of the interior of the carton from top to bottom. The second section of the carton is an upper box cover having a top, two sides walls, a front wall and a back wall. It is dimensioned to telescope over the lower box body so that the outside of the assembled carton is of a rectangular configuration.

In the plan drawings, solid lines indicate cuts and dashed lines indicate hinge lines formed by scoring the cardboard material.

DESCRIPTION OF THE PREFERRED EMBODIMENT

The asparagus carton of the present invention is preferably constructed from corrugated cardboard stock which has been wax-dipped to repel water and thus to maintain its rigidity in a wet environment. The carton stock is cut in the manner illustrated in FIGS. 4 and 5.

Figure 4:
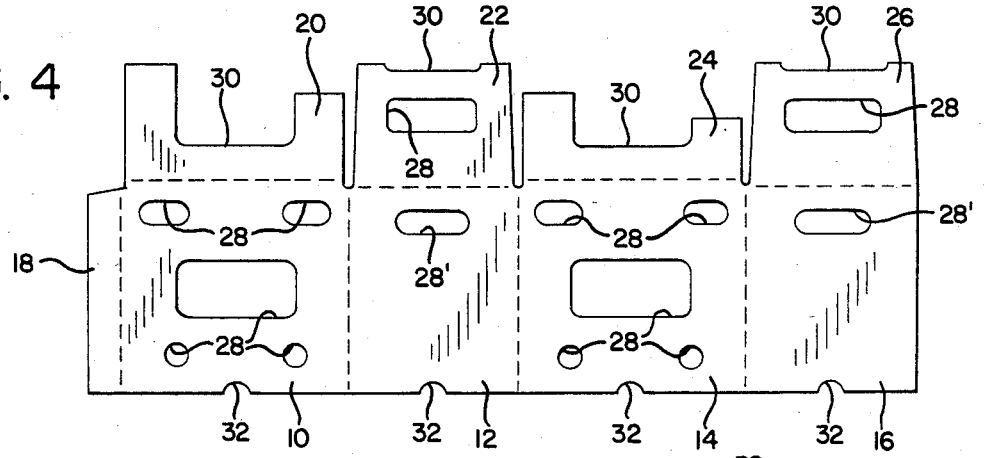
FIG. 4 is an outside plan view of the cardboard stock blank from which the upper box cover of the carton of FIG. 1 is constructed.

FIG. 4 illustrates the plan for the four-walled upper box cover. A front wall 10 is hinged to a first side wall 12, which is in turn hinged to a back wall 14, which is in turn hinged to a second side wall 16. A glue flap 18 is attached to the front wall and laps side wall 16 to from a hinge between the front wall and the second side wall.

A top is composed of top flaps 20, 22, 24 and 26, attached to walls 10, 12, 14 and 16 respectively.

Variously shaped holes 28 in the upper box cover allow air and water to circulate readily through the carton and around the produce. Holes 28' in the side walls also function as hand holes. Cut-outs 30 in the top flaps also form holes when the carton is assembled. Cut-outs 32 in the bottom edge of the walls of the box cover are for drainage in conjunction with similar holes in the lower box body as hereinafter described.

Figure 5:
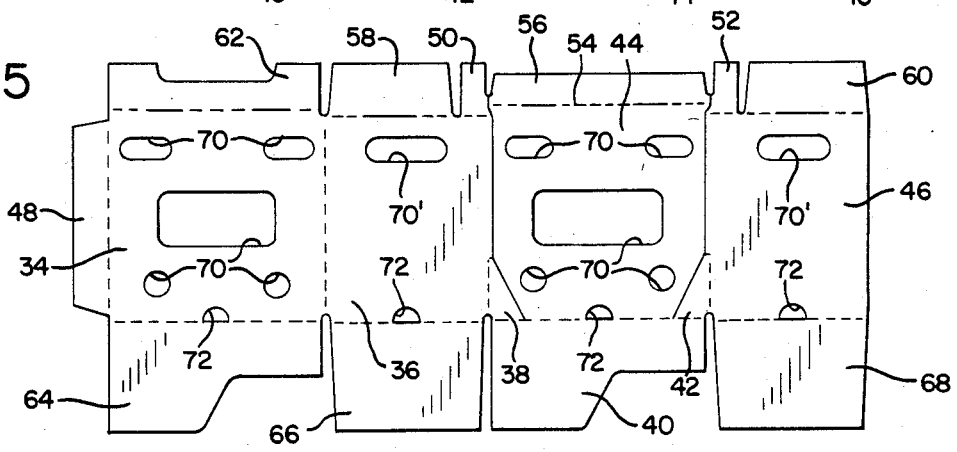
FIG. 5 is an inside plan view of the cardboard stock blank from which the lower box body of the carton of FIG. 1 is constructed.

FIG. 5 illustrates the plan for the associated four-walled lower box body. A back wall 34 is hinged to a first side wall 36. A first connecting web 38 is hinged to the first side wall on the front edge thereof. The first connecting web is in turn hinged to a bottom flap 40 along the bottom edge of the first connecting web. It can be seen that there is a right angle relationship between the hinge lines of side wall 36 and bottom flap 40 with connecting web 38.

A second connecting web 42 is hinged to the bottom flap on the opposite end of the same edge thereof as the first connecting web. The two connecting webs leave a substantial space between them along the edge of the bottom flap to which they are hinged. A front panel 44 is hinged to bottom flap 40 in this space.

A second side wall 46 is hinged to the second connecting web in a manner mirroring first connecting web 38. A glue flap 48 is attached to back wall 34 and spans between the back wall and the second side wall to form a hinge therebetween.

Figure 1:
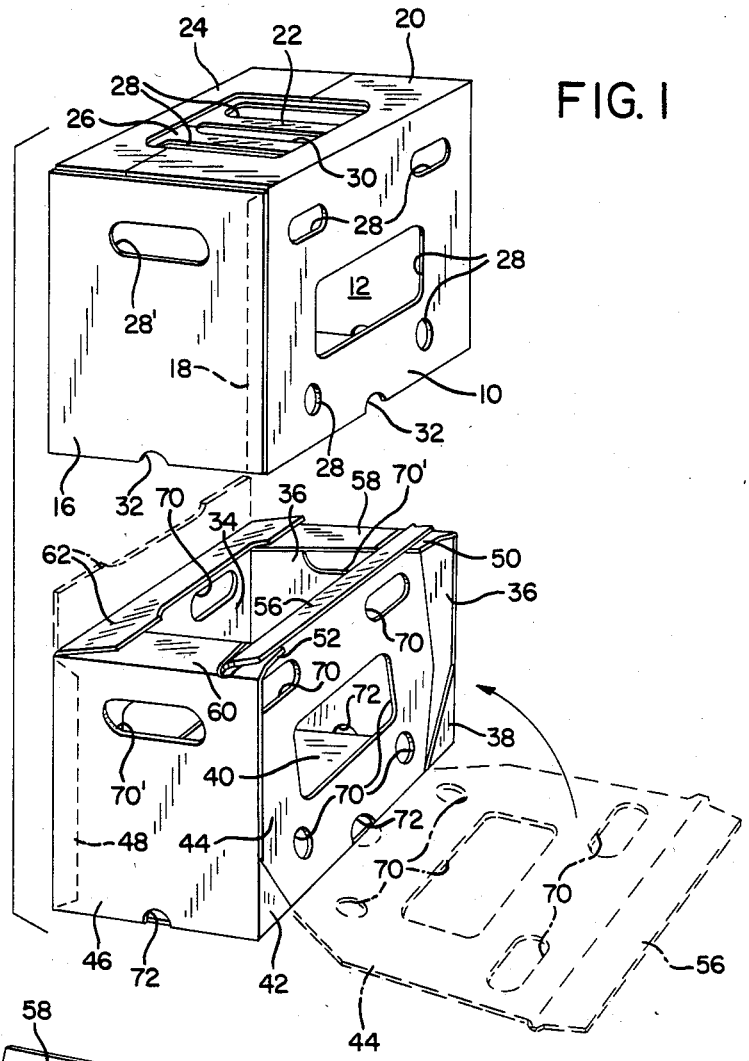
FIG. 1 is an exploded top perspective view of the two-piece asparagus carton of the present invention illustrating the upper box cover, and the lower box body with the front panel shown in dashed lines in an open position and in solid lines in a closed or assembled condition.

As best shown in FIG. 1, front panel 44 is foldable to a position wherein it slopes inwardly from vertical, extending from the bottom corner of the carton to a point substantially at the top of the carton, but spaced inwardly from the top corner thereof. This establishes the slope required to hold the tapered asparagus stalks.

A locking means is provided for releaseably locking the front panel in its sloping position. Preferably this comprises a pair of locking flaps 50 and 52 hinged to the top edges of side panels 36 and 46 respectively. Each flap has a rearwardly facing abutting edge at a distance spaced from the front of the carton.

Again referring to FIG. 5, the front panel includes an engagement surface 54 for engaging the abutting edge of the locking flap. A spacing flap 56 is hinged to the top edge of the front panel and is foldable to lap over the locking flaps. The spacing flap extends substantially to the top corner of the carton, abutting against the inside top corner of the cover.

Additional top flaps 58 and 60 are hinged to the top edge of side panels 36 and 46 respectively. Top flap 62 is hinged to the top edge of back wall 34.

A pair of first bottom flaps is attached to two opposed side walls. Preferably this pair includes bottom flap 40 attached to front panel 44 and to connecting webs 38 and 42, and an opposing bottom flap 64 attached to the bottom edge of back wall 34. Each of these flaps has a curved outer edge configured to mate with a similarly curved outer edge of the other flap. Preferably, the curve is of an S-shaped configuration as shown in the drawing.

In the assembled condition of the blank, these meeting, abutting edges prevent torquing, and lend stability to the box.

A second pair of bottom flaps 66 and 68 is attached to the other two opposed side walls, 36 and 46 respectively, and together are configured and dimensioned to cover substantially the entire bottom of the carton.

Variously shaped holes 70 in the lower box body allow air and water to readily circulate through the carton and around the produce. Holes 70' in the side walls also function as hand holes. Holes 72, adjacent the lower edges of the side walls, allow drainage of water from the carton. It can be seen that the holes in the lower box body correspond or register with the holes in the upper box cover when the two pieces are assembled.

OPERATION

Figure 2:
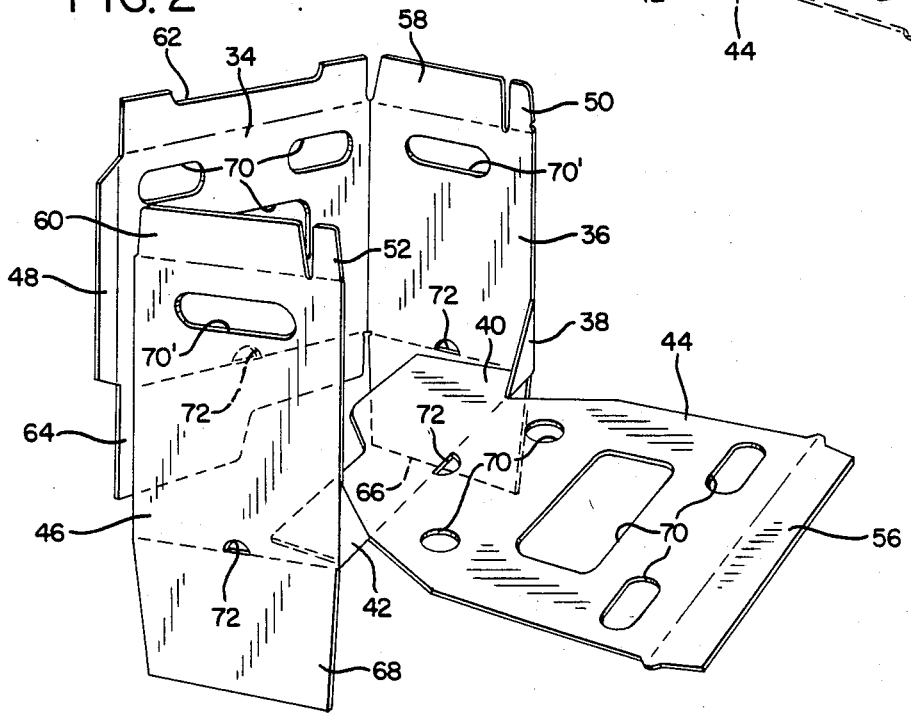
FIG. 2 is a top perspective view of the lower box body of the carton of FIG. 1, shown in a disassembled condition.

As best shown in FIG. 2., to assemble the lower box body of the asparagus carton of the present invention, back wall 34 and side walls 36 and 46 are folded into a substantially rectangular configuration. Glue flap 48 laps side wall 46 and forms a hinge between the back wall and the side wall. Bottom flaps 40 and 64 are folded perpendicularly to the side walls to form the bottom of the box. It will be noted that the curved edges of bottom flaps 40 and 64 meet with close tolerances. This prevents torqueing of the box about its vertical axis. Bottom flaps 66 and 68 are then folded in perpendicular to the side walls and fastened by means of stitching, staples (not shown) or the like.

This leaves the top and front of the carton substantially open to allow the asparagus to be packed into the carton. Once the carton has been filled, front panel 44 is folded to its slanted position. Then locking flaps 50 and 52 are folded over the top of the carton and into abutment with the engagement surface 54 of the front panel. Spacing flap 56 is folded down over the locking flaps and in this position extends to the top corner of the carton, where it abuts the inside top corner of the upper box cover.

Flaps 58, 60 and 62 are also folded over the top of the carton, perpendicular to the side walls.

Figure 3:
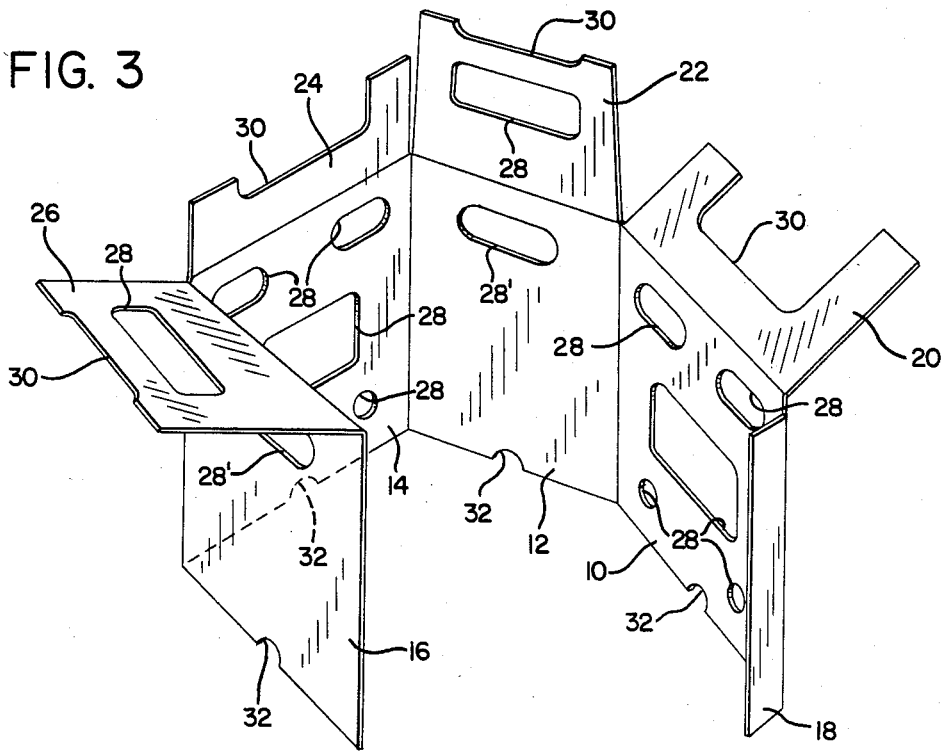
FIG. 3 is a top perspective view of the upper box cover of the carton of FIG. 1, shown in a disassembled condition.

Now, considering FIG. 3, the upper box cover of the asparagus carton of the present invention is assembled in a substantially similar manner. Front, back, and side walls 10, 14, 12 and 16 are folded into a substantially rectangular configuration. Glue flap 18 laps side wall 16 and forms a hinge between front wall 10 and side wall 16. Top flaps 22 and 26 are folded in perpendicular to the side walls, and then flaps 20 and 24 are also folded in and secured with staples, tape or the like. It will be noted that the upper box cover is substantially symmetrical and can fit over the lower box body in either of two orientations.

FIG. 1 illustrates that the final assembly of the asparagus carton involves simply placing the upper box cover over the lower box body in a telescoping fashion. The holes in the two sections of the carton register with one another to provide unrestricted flow of fluid through the carton. Considerable stacking strength is maintained because of the double wall formed around the perimeter of the carton. Further, the rectangular prismatic outside configuration of the carton allows the cartons to be stacked easily and safely one upon another.

When the produce arrives at the market place, the carton can be made to function readily as a display box simply by folding front panel 44 forwardly, as illustrated in FIG. 1, or completely back under the bottom of the carton.

In this manner there is provided a carton for packing and shipping asparagus which achieves the various objectives of the invention. Obvious modifications may be made to the structure without departing from the intended spirit and scope of the invention.

Having described my invention in its preferred embodiment, I claim:

1. A corrugated carton for securely packing for shipment produce such as asparagus, comprising in combination:

(a) a lower box body including:

(1) a bottom, two opposed upstanding side walls, and a rear wall;

(2) a front panel hinged to the bottom of the box body and foldable to a position wherein it slopes inwardly from vertical and inwardly of the front edges of the side walls, extending from the bottom front corner of the box body to a point substantially at the top of the box body, spaced inwardly from the top front edges of the side walls, the front panel being dimensioned to substantially close the front of the carton between said side walls in said sloping position; and (3) releasably engageable locking means on said front panel and side walls for releasably locking the front panel in its sloping position, said upstanding side walls, rear wall, front panel and locking means, which when locked in sloping position, define an open top for the lower box body, and (b) an upper box cover having a top, two side walls, a front wall and a back wall, and being dimensioned to telescope over the lower box body, and covering said open top.

2. The carton of claim 1 wherein the locking means includes a spacing flap hinged to the top edge of the front panel and foldable forwardly to extend substantially to the top front corner of the carton, abutting against the inside top front corner of the box cover.

3. A corrugated carton for securely packing produce such as asparagus for shipment, comprising a lower body including:

(a) a back wall;

(b) a first side wall hinged to the back wall on the vertical back edge of the first side wall;

(c) a first connecting web hinged to the first side wall on a lower portion of the vertical front edge of the first side wall;

(d) a bottom flap hinged to the first connecting web along the bottom edge of the first connecting web;

(e) a second connecting web hinged to the bottom flap on the opposite end of the same edge thereof as the first connecting web, the two connecting webs leaving a substantial space therebetween;

(f) a front panel hinged to the bottom flap between and separate from the two connecting webs, the front panel being foldable on the hinge connection to the bottom flap to a position wherein it slopes inwardly from the vertical front edges of the side walls, extending from the bottom front corner of the carton to a point substantially at the top of the carton, spaced inwardly from the top front corner thereof;

(g) a second side wall hinged on its front edge to the second connecting web;

(h) a glue flap spanning between the back wall and the second side wall and forming a hinge therebetween; and (i) locking means for releasably locking the front panel in its sloping position.

4. The carton of claim 3 further comprising a separate cover having a top, two side walls, a front wall and a back wall, and being dimensioned to telescope over the lower body of the carton and wherein the locking means comprises a spacing flap hinged to the top edge of the front panel and foldable to extend substantially to the top front corner of the carton, abutting against the inside top front corner of the cover.

5. The carton of claim 3 further comprising bottom flaps attached to the back wall and the side walls, two opposed bottom flaps having curved outer edges configured to mate along substantially the length of their curved outer edges in close, unlapped arrangement, and the other two opposed bottom flaps together being configured and dimensioned to cover substantially the bottom of the carton.

6. The carton of claim 5 wherein the curved outer edges of the first bottom flaps have an S-shaped configuration.

7. The carton of claim 3 wherein the front panel is foldable forwardly on the hinge connection to the bottom flap so that the carton can function as a display box.

8. The carton of claim 3 wherein the front panel is foldable completely back under the bottom of the carton.

9. A corrugated carton for securely packing for shipment produce such as asparagus, comprising in combination:

(a) a lower box body including:

(1) a bottom, two opposed upstanding side walls, and a rear wall;

(2) a front panel hinged to the bottom of the box body and foldable to a position wherein it slopes inwardly from vertical, extending from the bottom corner of the box body to a point substantially at the top of the box body, spaced inwardly from the top front corner thereof; and (3) locking means for releasably locking the front panel in its sloping position, comprising a locking flap hinged to the top of each side wall of the box body and foldable over the top of the box body toward but spaced from each other, each flap having a rearwardly facing abutting edge at a distance spaced from the front of the box body, and an engagement surface on the front panel for engaging the abutting edge of the locking flaps, said upstanding side walls, rear wall, front panel and locking means, which when locked in sloping position, define an open top for the lower box body, and (b) an upper box cover having a top, two side walls, a front wall and a back wall, and being dimensioned to telescope over the lower box body and covering said open top.

10. The carton of claim 9 wherein the engagement surface comprises a spacing flap hinged to the top edge of the front panel and foldable to lap over the locking flaps.

11. A corrugated carton for securely packing produce such as asparagus for shipment, comprising a lower body including:

(a) a back wall;

(b) a first side wall hinged to the back wall;

(c) a first connecting web hinged to the first side wall on the front edge thereof;

(d) a bottom flap hinged to the first connecting web along the bottom edge thereof;

(e) a second connecting web hinged to the bottom flap on the opposite end of the same edge thereof as the first connecting web, the two connecting webs leaving a substantial space therebetween;

(f) a front panel hinged to the bottom flap between the two connecting webs, the front panel being foldable to a position wherein it slopes inwardly from vertical, extending from the bottom corner of the carton to a point substantially at the top of the carton, spaced inwardly from the top corner thereof;

(g) a second side wall hinged on its front edge to the second connecting web;

(h) a glue flap spanning between the back wall and the second side wall and forming a hinge therebetween; and (i) locking means for releasably locking the front panel in its sloping position, the locking means comprising a locking flap hinged to the top of each side wall and foldable over the top of the carton, each flap having a rearwardly facing abutting edge at a distance spaced from the front of the carton, and an engagement surface on the front panel for engaging the abutting edge of the locking flaps.

12. The carton of claim 11 further comprising a spacing flap hinged to the top edge of the front panel and foldable to lap over the locking flaps.

* * * * *